US007585046B2

(12) United States Patent
Miyata

(10) Patent No.: US 7,585,046 B2
(45) Date of Patent: Sep. 8, 2009

(54) LIQUID-JET HEAD UNIT AND LIQUID-JET APPARATUS

(75) Inventor: Yoshinao Miyata, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 354 days.

(21) Appl. No.: 11/359,381

(22) Filed: Feb. 23, 2006

(65) Prior Publication Data

US 2006/0221116 A1 Oct. 5, 2006

(30) Foreign Application Priority Data

Feb. 24, 2005 (JP) ..... 2005-048892

(51) Int. Cl.
*B41J 2/01* (2006.01)

(52) U.S. Cl. ..... 347/20; 347/40; 347/17; 347/23

(58) Field of Classification Search ..... 347/20, 347/17, 40, 23
See application file for complete search history.

(56) References Cited

U.S. PATENT DOCUMENTS 5,818,479 A * 10/1998 Reinecke et al. ..... 347/47
5,880,763 A * 3/1999 Tanaka et al. ..... 347/70
2002/0051040 A1* 5/2002 Shimada et al. ..... 347/71
2004/0165037 A1* 8/2004 Kitahara ..... 347/65
2005/0195238 A1* 9/2005 Eguchi et al. ..... 347/20

FOREIGN PATENT DOCUMENTS

JP 10-86168 A 4/1998
JP 10-250065 A 9/1998

* cited by examiner

*Primary Examiner*—Manish S Shah
*Assistant Examiner*—Laura E Martin
(74) *Attorney, Agent, or Firm*—Sughrue Mion, PLLC

(57) ABSTRACT

Disclosed are a liquid-jet apparatus, and the liquid-jet head unit including: a liquid-jet head in which nozzle orifices for ejecting ink droplets are arranged in parallel lines; and a head case fixed to the liquid-jet head. A linear expansion coefficient in a reference direction, which is a direction in which the nozzle orifices of the head case are arranged in parallel lines, is set less than a linear expansion coefficient thereof in a direction orthogonal to the reference direction.

12 Claims, 6 Drawing Sheets

LIQUID-JET HEAD UNIT AND LIQUID-JET APPARATUS

BACKGROUND OF THE INVENTION

1. Field of the Invention

The present invention relates to a liquid-jet head unit including a liquid-jet head for injecting a liquid and a liquid-jet apparatus, and particularly relates to an ink jet recording head unit including an ink jet recording head for ejecting ink as the liquid and an ink jet recording device.

2. Background art

An ink jet recording device, such as an ink jet printer or an ink jet plotter includes an ink jet recording head unit (hereinafter, referred to as a head unit) including an ink jet recording head capable of ejecting, as ink droplets, ink reserved in an ink reservoir portion of an ink cartridge or an ink tank.

The head unit includes: an ink jet recording head including nozzle lines, each of which is formed of nozzle orifices arranged in parallel lines; a head case fixed to ink supply ports side of the ink jet recording head; and a cover head protecting an ink-droplet ejecting surface side of the ink jet recording head.

Since the head case of the head unit as described above is generally formed of a resin material such as plastic, there is a problem that, due to a difference in linear expansion coefficients between the head case and a single crystal silicon substrate constituting the ink jet recording head, the head case warps due to a temperature change. Particularly when the warpage occurs in a direction, in which the nozzle orifices are arranged in parallel lines, impact positions which ink droplets impact on a recording medium such as a sheet of paper are displaced. Accordingly there is a problem that printing quality is deteriorated.

Additionally, since the direction, in which the lines of nozzle orifices are arranged in parallel lines, is generally a longitudinal direction of the ink jet recording head, the ink jet recording head warps in a manner that the nozzle plate side becomes convex in the longitudinal direction. As a result, there is a problem that a nozzle plate and a passage-forming substrate are separated.

Furthermore, although the warpage of the ink jet recording head is prevented if the head case is formed of a single crystal silicon substrate or a ceramic which has the same linear expansion coefficient as that of the material of the ink jet recording head, such a material is expensive and there arises a problem that costs are increased.

Note that, as a constituting member of an ink jet printer, one using a liquid crystal polymer has been proposed (for example, refer to Japanese Patent Application Laid-open No. 10-86168).

However, in the above patent literature, disclosed is only to mold the constituting member with high precision by reducing a mold shrinkage factor of the member in a longitudinal direction.

SUMMARY OF THE INVENTION

In consideration of the above described situations, a problem of the present invention is to provide a liquid-jet head and a liquid-jet apparatus which are respectively capable of enhancing printing quality by reducing warpage of heads thereof, and for which costs are reduced.

A first aspect of the present invention for solving the above problem is a liquid-jet head unit characterized by including: a liquid-jet head in which nozzle orifices for injecting ink droplets are arranged in parallel to each other; and a head case fixed to the liquid-jet head. The liquid-jet head unit is characterized in that a linear expansion coefficient of the head case in a reference direction, which is a direction in which the nozzle orifices are arranged in parallel lines, is set less than a linear expansion coefficient thereof in a direction orthogonal to the reference direction.

In the first aspect, the liquid-jet head unit becomes possible to reduce warpage in the direction in which the nozzle orifices are arranged in parallel lines, whereby printing quality of the head unit can be enhanced.

A second aspect of the present invention is the liquid-jet head unit in the first aspect, which is characterized in that: the reference direction of the head case is a longitudinal direction of the liquid-jet head.

In the second aspect, by reducing warpage of the liquid-jet head unit in the longitudinal direction, it is possible to reliably prevent separation between a nozzle plate on which nozzle orifices are provided, and a passage-forming substrate on which pressure generating chambers are formed.

A third aspect of the present invention is the liquid-jet head unit in the first or second aspect, which is characterized in that the head case is formed of a liquid crystal polymer.

In the third aspect, while reducing warpage of the liquid-jet head unit in the direction in which the nozzle orifices are arranged in parallel lines, it is possible to reduce a cost for the head unit.

A fourth aspect of the present invention is the liquid-jet head unit in any one of the first to third aspects, which is characterized in that the liquid-jet head includes a passage-forming substrate formed of a single crystal silicon substrate. On the passage-forming substrate, pressure generating chambers communicating with the respective nozzle orifices are respectively formed in divisions, and the head case is fixed to the passage-forming substrate.

In the fourth aspect, it is possible to prevent warpage and destruction of the passage-forming substrate formed of the single crystal silicon substrate.

A fifth aspect of the present invention is the liquid-jet head unit in the fourth aspect, which is characterized in that the head case is fixed to the passage-forming substrate with a protective plate, which is connected to the passage-forming substrate, interposed in between the head case and the passage-forming substrate. The protective plate is formed of a material having a linear expansion coefficient substantially equal to a linear expansion coefficient of the passage-forming substrate.

In the fifth aspect, it is possible to reduce warpage of the passage-forming substrate and of the protective plate and to prevent separation between the passage-forming substrate and the protective plate. Thereby, printing quality of the head unit can be enhanced.

A sixth aspect of the present invention is the liquid-jet head unit in any one of the first to fifth aspects, which is characterized in that the head case is molded in order that the reference direction can be an injection flow direction.

In the sixth aspect, it becomes possible to easily mold the head case having a predetermined linear expansion coefficient.

A seventh aspect of the present invention is a liquid-jet apparatus characterized by including the liquid-jet head in any one of the first to sixth aspects.

In the seventh aspect, it is possible to realize a liquid-jet apparatus enhanced in printing quality.

DESCRIPTION OF THE PREFERRED EMBODIMENTS

Hereinbelow, the present invention will be described in detail based on embodiments.

Embodiment 1

Figure 1:
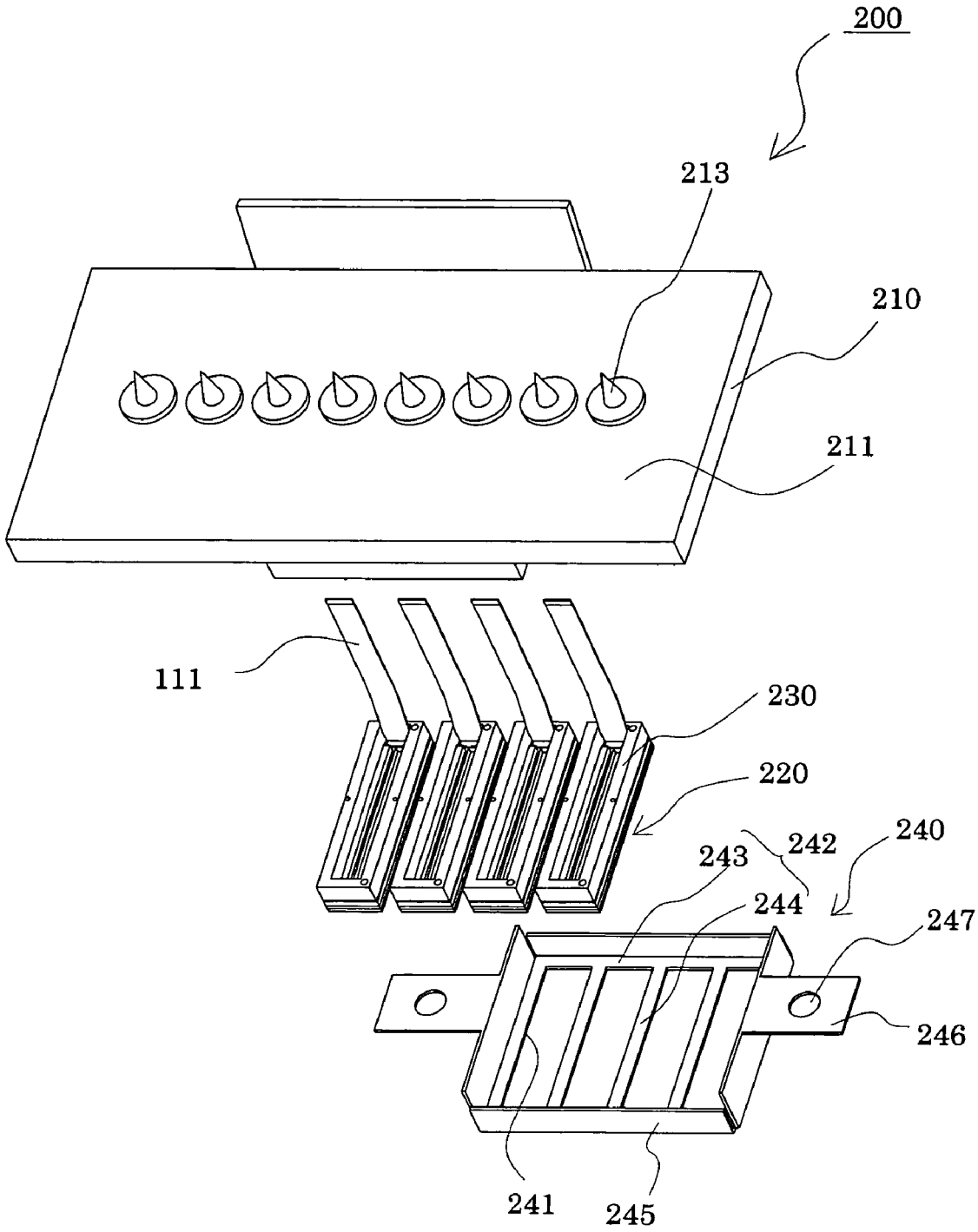
FIG. 1 is an exploded perspective view of a head unit according to Embodiment 1.
Figure 2:
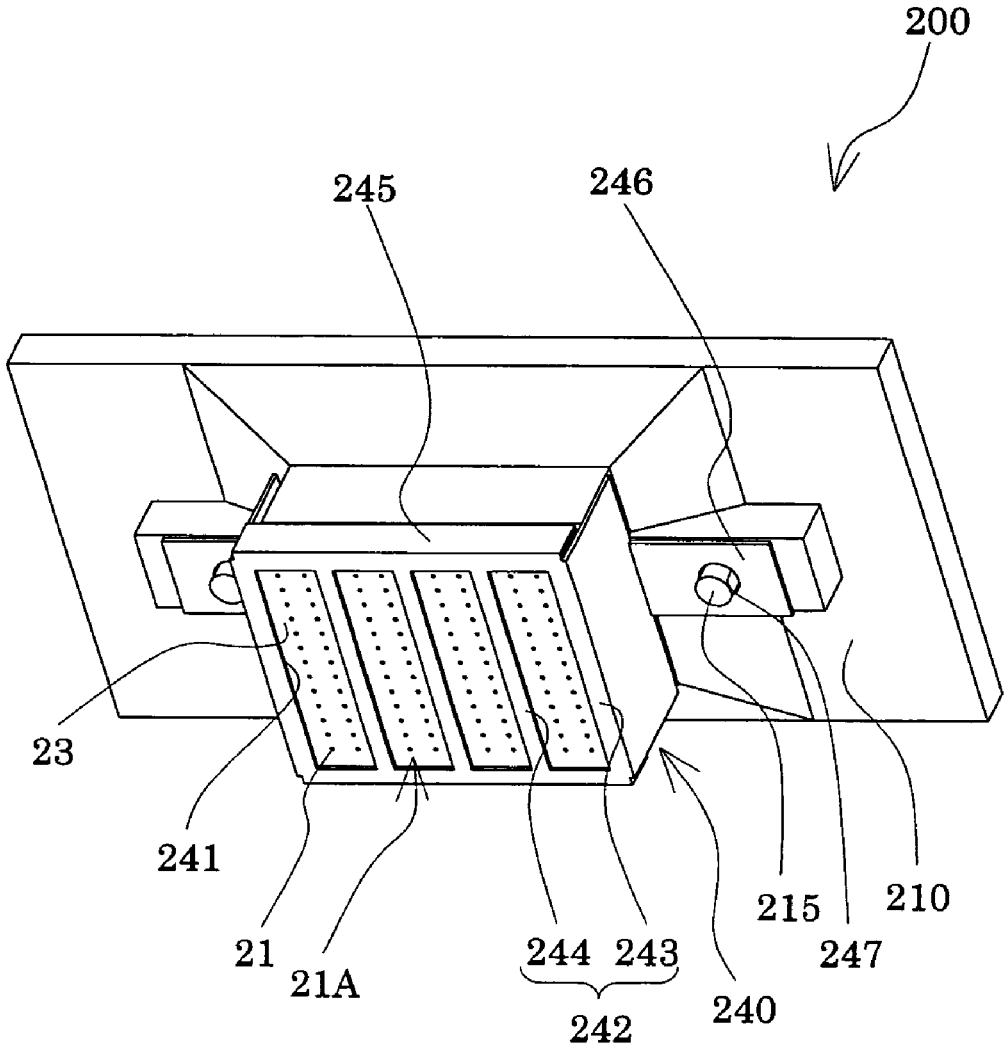
FIG. 2 is an assembled perspective view of the head unit according to Embodiment 1.
Figure 3:
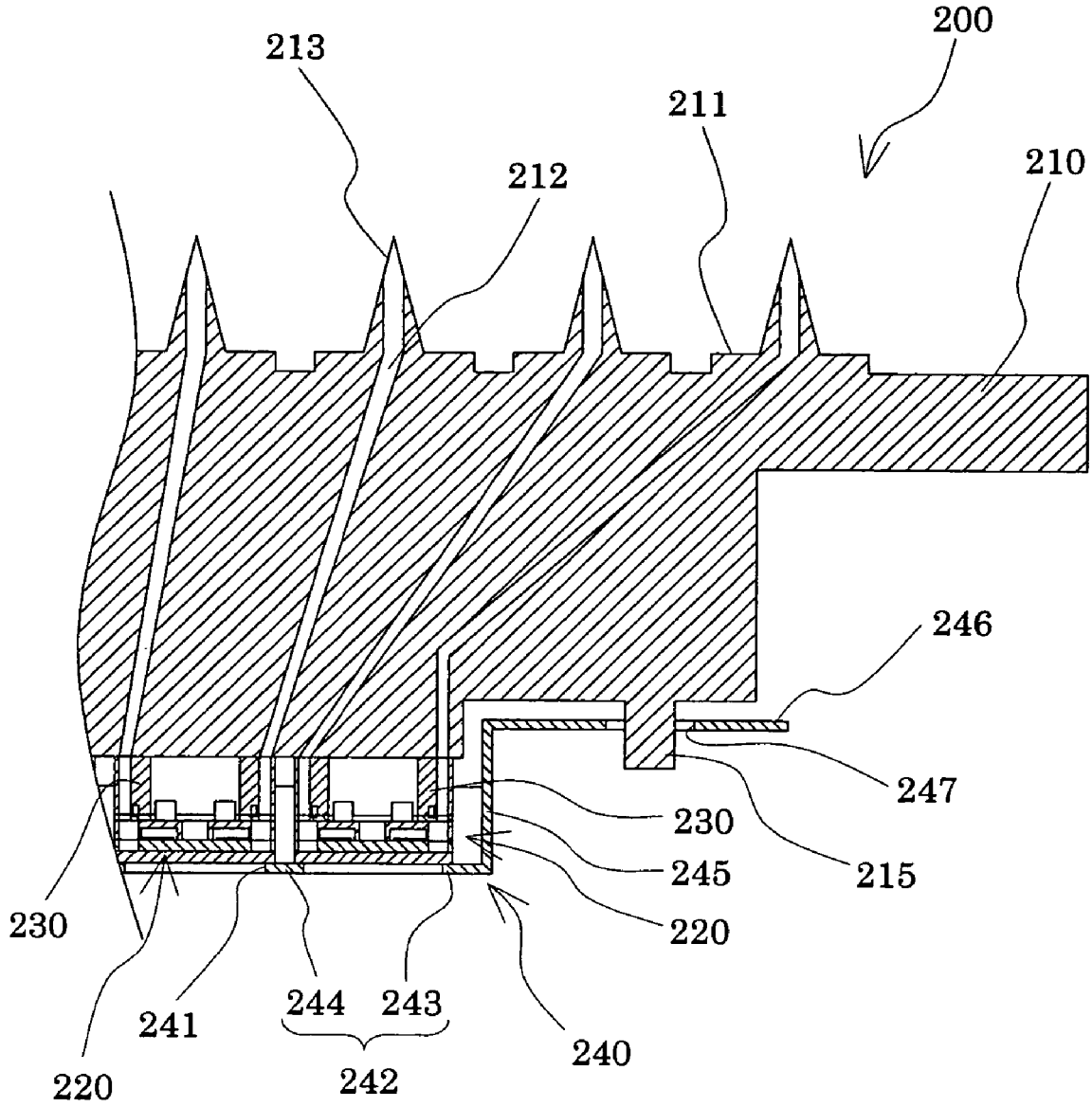
FIG. 3 is a cross-sectional view of a main part of the head unit according to Embodiment 1.

FIG. 1 is an exploded perspective view of an ink jet recording head unit according to Embodiment 1 of the present invention, FIG. 2 is an assembled perspective view of the ink jet recording head, and FIG. 3 is a cross-sectional view of a main part of the ink jet recording head. As illustrated in FIG. 1, a cartridge case 201, which is a holding member constituting an ink jet recoding head unit 200 (herein after, referred to as the head unit 200), includes cartridge mounting portions 211 on which ink cartridges (not illustrated) are respectively mounted. For example, in this embodiment, the ink cartridges are constituted respectively of separate components filled with black ink and color ink of three colors, and the respective cartridges of the black and color ink are mounted on a cartridge case 210. On a bottom surface of the cartridge case 210, a plurality of ink communicating paths 212 are provided as shown in FIG. 3. One end of each of the communicating paths 212 opens to each of the cartridge mounting portions 211, and the other end thereof opens to a head case described later. Furthermore, ink supply needles 213 are fixed respectively to opening portions of the respective ink communicating paths 212 of the cartridge mounting portions 211, with filters (not illustrated) respectively interposed between the ink supply needle 213 and the opening portion. Each of the ink supply needles 213 is inserted into an ink supply port of one of the ink cartridge. Each of the filters is formed in the ink communicating paths 212 in order to remove foams and foreign materials in ink.

The cartridge case 210 as described above includes, on the bottom surface thereof, head cases 230 to each of which an ink jet recording head 220 is fixed on an end face thereof not facing the cartridge case 210. Each of the ink jet recording head 220 includes a plurality of piezoelectric elements 300 and ejects ink droplets from nozzle orifices 21 by driving the piezoelectric elements 300. In this embodiment, a plurality of the ink jet recording heads 220 for ejecting ink of each of color in the ink cartridges is provided in such a manner that the ink jet recording heads 220 correspond to the respective colors of ink, and also, a plurality of the head cases 230 are provided independently from one another in such a manner that the head cases 230 correspond to the respective ink jet recording heads 220.

Figure 4:
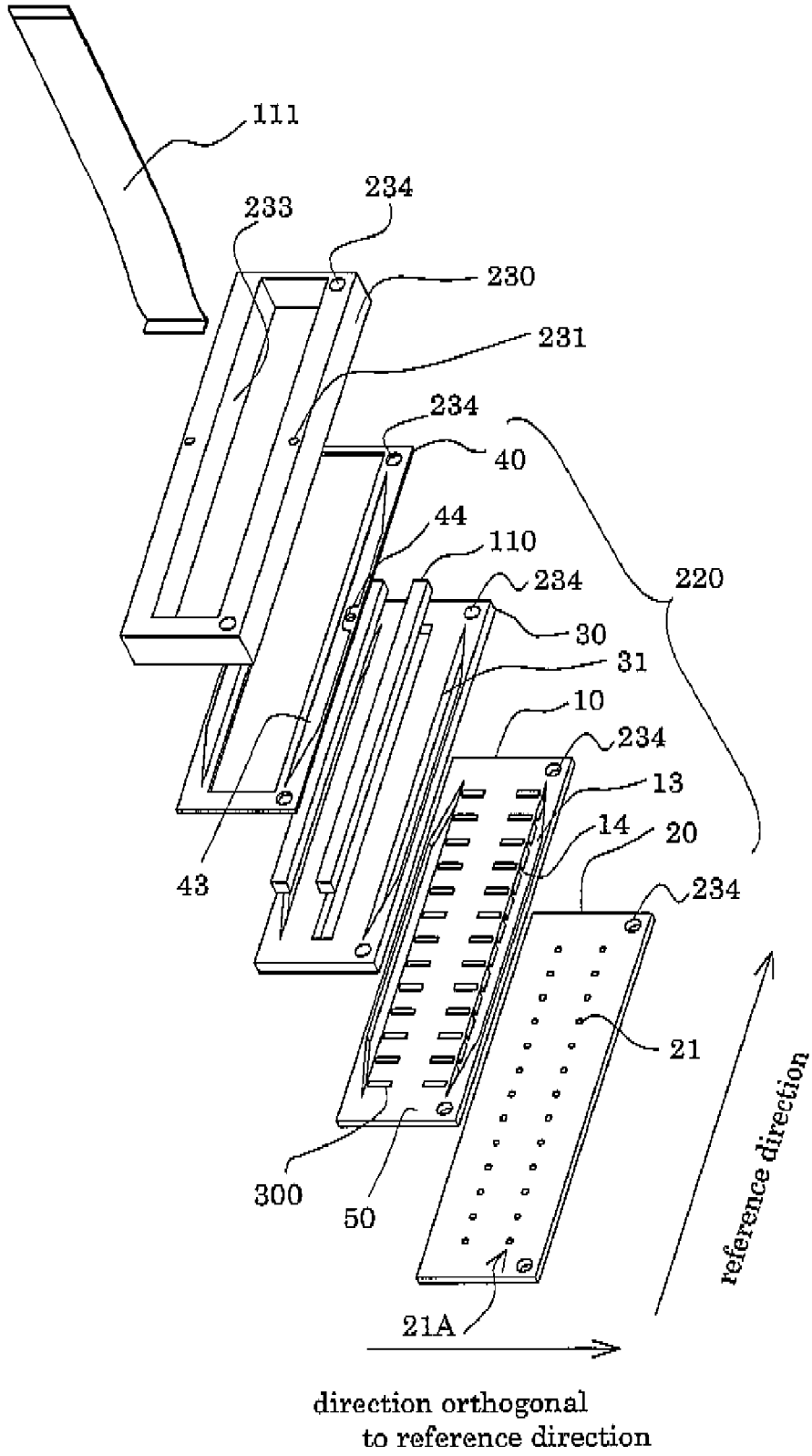
FIG. 4 is an exploded perspective view of a main part of the head unit according to Embodiment 1.
Figure 5:
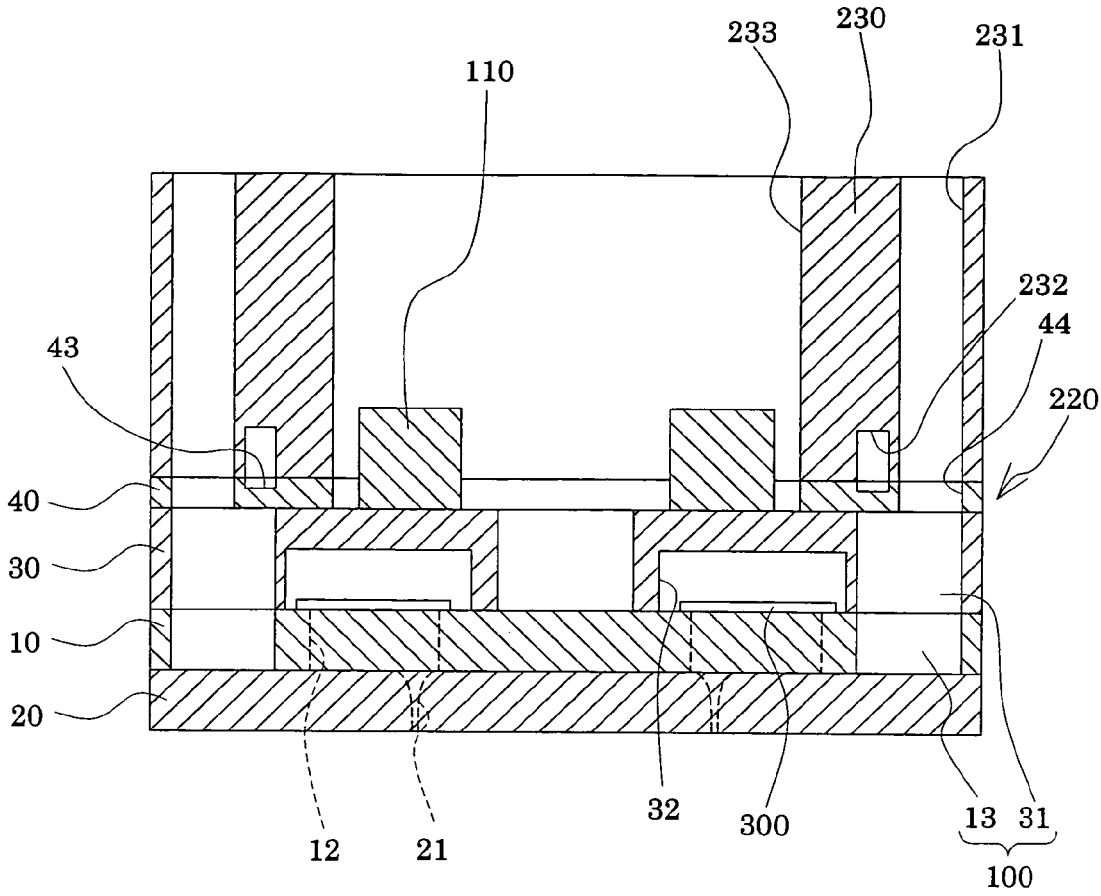
FIG. 5 is a cross-sectional view of a head case and a recording head according to Embodiment 1.

Here, descriptions will be given of the ink jet recording heads 220 and the head cases 230 of this embodiment which are mounted on the cartridge case 210. FIG. 4 is an exploded perspective view of the ink jet recording head and the head case. FIG. 5 is a cross-sectional view of the recording head and the head case. As illustrated in the FIGS. 4 and 5, a passage-forming substrate 10 constituting the ink jet recording head 220 is formed of a single crystal silicon substrate whose linear expansion coefficient is 2.6 ($10^{-6}$/° C.). Additionally, on one side surface of the passage-forming substrate 10, there is formed an elastic film 50 formed of silicon dioxide previously obtained through thermal oxidation. On the passage-forming substrate 10, by applying anisotropic etching thereto from the other side surface thereof, two lines of pressure generating chambers 12 divided by a plurality of compartment walls are formed in parallel to each other in a width direction thereof. Furthermore, in a region outward from each of the lines of the pressure generating chambers 12 in a longitudinal direction thereof, a communicating portion 13 is formed. By communicating with a reservoir portion 31 provided on a protective plate 30 described later, the communicating portion 13 constitutes a part of a reservoir 100 serving as a common ink chamber of the respective pressure generating chambers 12. The communicating portion 13 is communicated with one edge portion of each of the pressure generating chambers 12 in the longitudinal direction thereof, through ink supply paths 14.

Additionally, on an opening-surface side of the passage-forming substrate 10, a nozzle plate 20, to which nozzle orifices 21 are provided as through holes, is fixed with an adhesive agent or a thermal welding film. Each of the nozzle orifices 21 communicates with one of the respective pressure generating chambers 12 in a side thereof opposite a side where the one pressure generating chamber 12 communicates with the ink supply path 14. That is, in this embodiment, two nozzle lines 21, in which the nozzle orifices 21 are arranged in parallel to each other, are provided in each of the ink jet recording heads. Note that, the nozzle plate 20 is formed of a piece of glass ceramic, a single crystal silicon substrate, stainless steel or the like which has a thickness, for example, from 0.01 to 1 mm and a coefficient of linear expansion from 2.5 to 4.5 ($10^{-6}$/° C.) under a temperature not more than 300° C.

On the other hand, on a side opposite the opening-surface of the passage-forming substrate 10, on the elastic film 50, piezoelectric elements 300 are formed by sequentially laminating a lower electrode film formed of metal, a piezoelectric layer formed of lead zirconate titanate (PZT) or the like, and an upper electrode film formed of metal. A protective plate 30, which includes the reservoir portion 31 constituting at least a part of a reservoir 100, is connected to the passage-forming substrate 10 on which the above described piezoelectric elements 300 are formed. This reservoir portion 31 penetrates through the protective plate 30 in a thickness direction, and is formed across in a width direction of the pressure generating chamber 12. By communicating with the communicating portion 13 of the passage-forming substrate 10 as described above, the reservoir portion 31 constitutes the reservoir 100 serving as the common ink chamber of the respective pressure generating chambers 12.

On a region of the protective plate 30 facing each of the piezoelectric elements 300, there is provided a piezoelectric element holding portion 32 including a space, which is large only to the extent that it does not disturb movements of the piezoelectric elements 300. As materials for the protective plate 30 as described above, glass, ceramic, a metal, plastic or the like can be cited, and it is preferable to use a material having a thermal expansion coefficient substantially equal to that of the passage-forming substrate 10. In this embodiment, the protective plate 30 is formed of a single crystal silicon substrate, which is the same material as that of the passage-forming substrate 10.

Furthermore, on the protective plate 30, driver ICs 110 for driving the respective piezoelectric elements 300 are provided. Each terminal of the driver ICs 110 are respectively connected, through bonding wires or the like not illustrated, to lead wiring lines drawn out from an individual electrode of the respective piezoelectric elements 300. Additionally, as shown in FIG. 1, the respective terminals of the driver ICs 110 are connected to an outside through an external wiring 111 formed of a flexible print cable (FPC) or the like, whereby the respective terminals are configured to receive various signals such as a print signal from the outside through the external wiring 111.

Additionally, a compliance plate 40 is connected to the protective plate 30. On the compliance plate 40, in a region facing the reservoir 100, an ink introducing port 44 for supplying ink to the reservoir 100 is formed in such a manner that the ink introducing port 44 penetrates the compliance plate 40 in a thickness direction thereof. On the other hand, on the compliance plate 40, a region other than the ink introducing port 44 in the region facing the reservoir 100 is a flexible portion 43 formed thinly in a thickness direction, and the reservoir 100 is sealed by the flexible portion 43. Compliance is given to an interior of the reservoir 100 by the flexible portion 43.

As described above, the ink jet recording head 220 of this embodiment is constituted of four substrates which are the nozzle plate 20, the passage-forming substrate 10, the protective plate 30, and the compliance plate 40. A head case 230 is fixed onto the compliance plate 40 of the above described ink jet recording head 220. In the head case 230, ink communicating paths 231 are provided. The ink communication paths 231 supply ink from the cartridge case 210 to the respective ink introducing ports 44 in a configuration where the respective ink communication paths 231 communicate with the ink introducing ports 44 while communicating with the ink communicating paths 212 of the cartridge case 210. On this head case 230, a concave portion 232 is formed in a region facing each of the flexible portions 43, whereby the flexible portions 43 can undergo flexure deformation as appropriate. Additionally, on the head case 230, in a region facing the driver ICs 110 provided on the protective plate 30, there is provided a driver IC holding portion 233 penetrating the head case 230 in a thickness direction thereof. The external wiring 111 is connected to the driver ICs 110 in such a manner that the external wiring 111 is inserted into and led through the driver IC holding portion 233.

A linear expansion coefficient of the above described head case 230 in a reference direction, which is a direction in which nozzle orifices 21 are arranged in parallel lines, is set to be less than a linear expansion coefficient thereof in a direction orthogonal to the reference direction. Additionally, it is preferable that the linear expansion coefficient of the head case 230 in the reference direction be set to be nearly equal to each of linear expansion coefficients of the passage-forming substrate 10 formed of a single crystal silicon substrate and of the protective plate 30, the linear expansion coefficient being 2.6 ($10^{-6}$/° C.) in this embodiment. As a material for the above described head case 230, a liquid crystal polymer can be used. Note that, in a case where a liquid crystal polymer is used to form the head case 230, when the head case 230 is formed by molding, the linear expansion coefficient of the head case 230 in the reference direction can be set to be less than the linear expansion coefficient thereof in the direction orthogonal to the reference direction by setting the injection flow direction as the reference direction.

Here, linear expansion coefficients of representative liquid crystal polymers are shown in Table 1 presented below. Note that, in Table 1 presented below, grades of the respective liquid crystal polymers are indicated in product names manufactured by Polyplastics Co., Ltd.

TABLE 1

| Raw material and grade | Direction | Linear expansion coefficient (at room temperature) |
|---|---|---|
| VECTRA A150B | Reference direction | $1.8 \times 10^{-6}$ |
| | Direction orthogonal to reference direction | $46 \times 10^{-6}$ |
| VECTRA A230 | Reference direction | $2.0 \times 10^{-6}$ |
| | Direction orthogonal to reference direction | $48 \times 10^{-6}$ |
| VECTRA B230 | Reference direction | 0 |
| | Direction orthogonal to reference direction | $32 \times 10^{-6}$ |
| VECTRA A410 | Reference direction | $7 \times 10^{-6}$ |
| | Direction orthogonal to reference direction | $42 \times 10^{-6}$ |

Each of the liquid crystal polymers shown in Table 1 is usable as a material for the head case 230 of the present invention. For the head case 230 of the present invention, use of any one of VECTRA A150B, VECTRA A230 and VECTRA B230 is particularly favorable.

As described above, it is possible to prevent warpage from occurring due to a temperature change in the reference direction of the ink jet recording head 220 which is a direction along the parallel lines of nozzle orifices 21 by setting the linear expansion-coefficient of the head case 230 in the reference direction to be less than a linear expansion coefficient thereof in a direction orthogonal to the reference direction, and also to be substantially equal to a linear expansion coefficient of the ink jet recording head 220 to which the head case 230 is fixed. The linear expansion coefficient of the ink jet recording head 220 is, in other words, each of linear expansion coefficients of the passage-forming substrate 10 and of the protective plate 30. From this, impact positions of ink droplets are prevented from being displaced, and hence it is possible to enhance printing quality. Additionally, in order to set the linear expansion coefficient of the head case 230 to be substantially equal to each of linear expansion coefficients of the passage-forming substrate 10 and of the protective plate 30 which constitute the ink jet recording head, by using a liquid crystal polymer for the head case 230, it is not necessary to use therefore a single crystal silicon substrate which is the same material as that of the passage-forming substrate 10 and of the protective plate 30. Thereby, cost reduction is realized.

Furthermore, in this embodiment, the reference direction, in which the linear expansion coefficient of the head case 230 is small, is identical with a longitudinal direction of the ink jet recording head 220. Thereby, the head case 230 prevents warpage of the ink jet recording head 220 in the longitudinal direction. By thus preventing the warpage of the ink jet recording head 220 in the longitudinal direction, it is possible to reliably prevent separation of adhesion between the passage-forming substrate 10 and the nozzle plate 20. Note that, although the linear expansion coefficient of the head case 230 in the direction orthogonal to the reference direction is different from the linear expansion coefficients of the passage-forming substrate 10 and of the protective plate 30, an influence from warpage is reduced to a minimum because the direction orthogonal to the reference direction is a non-longitudinal direction of the ink jet recording head 220.

The ink jet recording head 220 of this embodiment as described above introduces ink, which has come out from the ink cartridge, from each of the ink introducing ports 44 through the ink communicating path 212 and the ink supply communicating path 231, and fills interiors from the reservoir 100 to the nozzle orifice 21 with the ink. Afterwards, in accordance with recording signals from the driver IC 110, a voltage is applied to the respective piezoelectric elements 300 corresponding to the pressure generating chambers 12, whereby the elastic film 50 and the piezoelectric elements 300 undergoes flexure deformation. As a result, pressure in the respective pressure generating chambers 12 is increased, whereby ink droplets are ejected through the nozzle orifice 21.

To the respective members constituting the above described ink jet recording head 220 and to the head case 230, pin insertion holes 234 are provided in two corner portions of each of the members and of the head case 230. The pin insertion holes 234 are used for aligning the respective members when the members are assembled. Then, while the members are being aligned relatively to each other by having pins inserted into the pin insertion holes 234, members are joined. Thereby, the ink jet recording head 220 and the head case 230 are formed integrally.

Note that the above described ink jet recording head 220 is formed as the ink jet recording head 220 in the following manner. A large number of chips are formed on a silicon wafer simultaneously, and the nozzle plate 20 and the compliance plate 40 are adhered and integrated. Then, the integrated body is divided into the respective passage-forming substrates 10, each of which is one-chip size as shown in FIG. 1, and then the ink jet recording head 220 is formed.

Four sets of the ink jet recording head 220 and the head case 230 as described above are fixed onto the above described cartridge case 210 at predetermined intervals in a direction along which the nozzle lines 21A are arranged. That is, the eight nozzle lines 21A are provided in the head unit 200 of this embodiment. In the case where the number of the nozzle lines 21A formed of the nozzle orifices 21 arranged in parallel to each other is thus increased by using the plurality of ink jet recording heads 220, it is possible to prevent reduction in yield as compared with a case where a number of the nozzle lines 21 is formed in the single ink jet recording head 220. Additionally, by using the plurality of ink jet recording heads 220 in order to increase the number of the nozzle lines 21, it is possible to increase an available number of the ink jet recording heads 220 formed from one silicon wafer can be increased. Thereby, waste regions of the silicon wafer are reduced, and a manufacturing cost for the ink jet recording head 220 is reduced.

As shown in FIGS. 1 and 2, the four ink jet recording heads 220, each of which is held by the cartridge case 210 with the head case 230 interposed therebetween, are held in a manner that the four ink jet recording heads 220 are aligned relatively to each other by the cover head 240 having a box shape so as to cover the four inkjet recording heads 220. The cover head 240 includes: an exposure opening portion 241 for exposing the nozzle orifices 21; and a joint portion 242. While dividing the exposure opening portions 241, the joint portion 242 is connected to at least both edge portions the nozzle lines 21A of the nozzle orifices 21 arranged in parallel to each other in an ink-droplet ejecting surface of the ink jet recording heads 220.

The joint portion 242 is constituted of a frame portion 243 and beam portions 244. The frame portion 243 is provided along the perimeter of the ink-droplet ejecting surface across the plurality of ink jet recording heads 220. Each of the beam portions 244 is provided so as to extend between adjacent ones of the ink jet recording heads 220 and divides each of the exposure opening portions 241. The frame portion 243 and the beam portions 244 are connected to the ink-droplet ejecting surface of the ink jet recording heads 220. Additionally, the frame portion 243 of the joint portion 242 is formed so as to cover the pin insertion holes 234 for aligning the respective members thereof when the ink jet recording head 220 is manufactured. Moreover, in the cover head 240, a sidewall portion 245 is provided toward side surfaces of the ink-droplet ejecting surface in a manner that the sidewall portion 245 extends so as to bend across the outer peripheral portion of the ink-droplet ejecting surface.

As described above, the cover head 240 is configured to have the joint portion 242 adhered to the ink-droplet ejecting surface of the ink jet recording head 220. Thereby, it is possible to reduce a step height between the ink-droplet ejecting surface and the cover head 240, and as a result, it is possible to prevent ink from remaining on the ink-droplet ejecting surface even when a wiping or an aspirating operation is performed on the ink-droplet ejecting surface. Additionally, since regions between each of the adjacent ink jet recording heads 220 are covered with the beam portions 244, ink cannot intrude between the adjacent ink jet recording heads 220, whereby it is possible to prevent deterioration and destruction of the piezoelectric elements 300 and the driver ICs 110, the deterioration and destruction being caused by ink. Moreover, since an interface between the ink-droplet ejecting surface of the ink jet recording heads 220 and the cover head 240 is adhered by use of an adhesive agent without leaving any clearance therebetween, a recorded medium is prevented from entering in a clearance therebetween, whereby it is possible to prevent deformation of the cover head 240, and paper jams. Furthermore, by having the sidewall portion 245 cover the outer peripheral portion of the plurality of ink jet recording heads 220, it is possible to reliably prevent ink from flowing around to side surfaces of the ink jet recording heads 220. In addition, because the joint portion 242 connected to the ink-droplet ejecting surface of the ink jet recording heads 220 is configured to be provided to the cover head 240, it is possible to perform the junction between the ink-droplet ejecting surface and the cover head 240 in such a manner that the respective nozzle lines 21A of the plurality of ink recording heads 220 are aligned with high precision to the cover head 240.

As a material for the cover head 240, for example, a metal material such as stainless steal can be cited. The metal plate therefore may be formed through press working, or may be formed through molding. Additionally, by forming the cover head 240 from a conductive metal material, the cover head 240 can be connected to ground. Note that the junction between the cover head 240 and the nozzle plate 20 is not particularly limited, and the junction may be performed through adhesion using, for example, a thermosetting epoxy adhesive agent, or an ultraviolet curing adhesive agent.

Additionally, to the joint portion 242, flange portions 246 each provided with a fixing hole 247 used to align and fix the cover head 240 to another member. These flange portions 246 are provided in a manner bending from the sidewall portion 245 so as to protrude in the same direction as a plane direction of the ink-droplet ejecting side. In this embodiment, as shown in FIGS. 2 and 3, the cover head 240 is fixed to the cartridge case 210 which is a holding member holding the ink jet recording heads 220 and the head cases 230. In detail, as shown in FIGS. 2 and 3, projections 215, which project toward the ink-droplet ejecting side and are inserted into the respective fixing holes 247 of the cover head 240, are provided to the cartridge case 210, and the cover head 240 is fixed to the cartridge case 210 by heating the extremities of the projections 215 to caulk the fixing holes 247 of the flange portions 246 while inserting the projections 215 into the fixing holes 247 of the cover head 240. By allowing the respective projections 215, which are provided to the cartridge case 210 as described above, to have an outer diameter smaller than a diameter of the respective fixing holes 247, the cover head 240 can be fixed to the cartridge case 210 in a manner that the cover head 240 is aligned in the plane direction of the ink-droplet ejecting surface.

Figure 6:
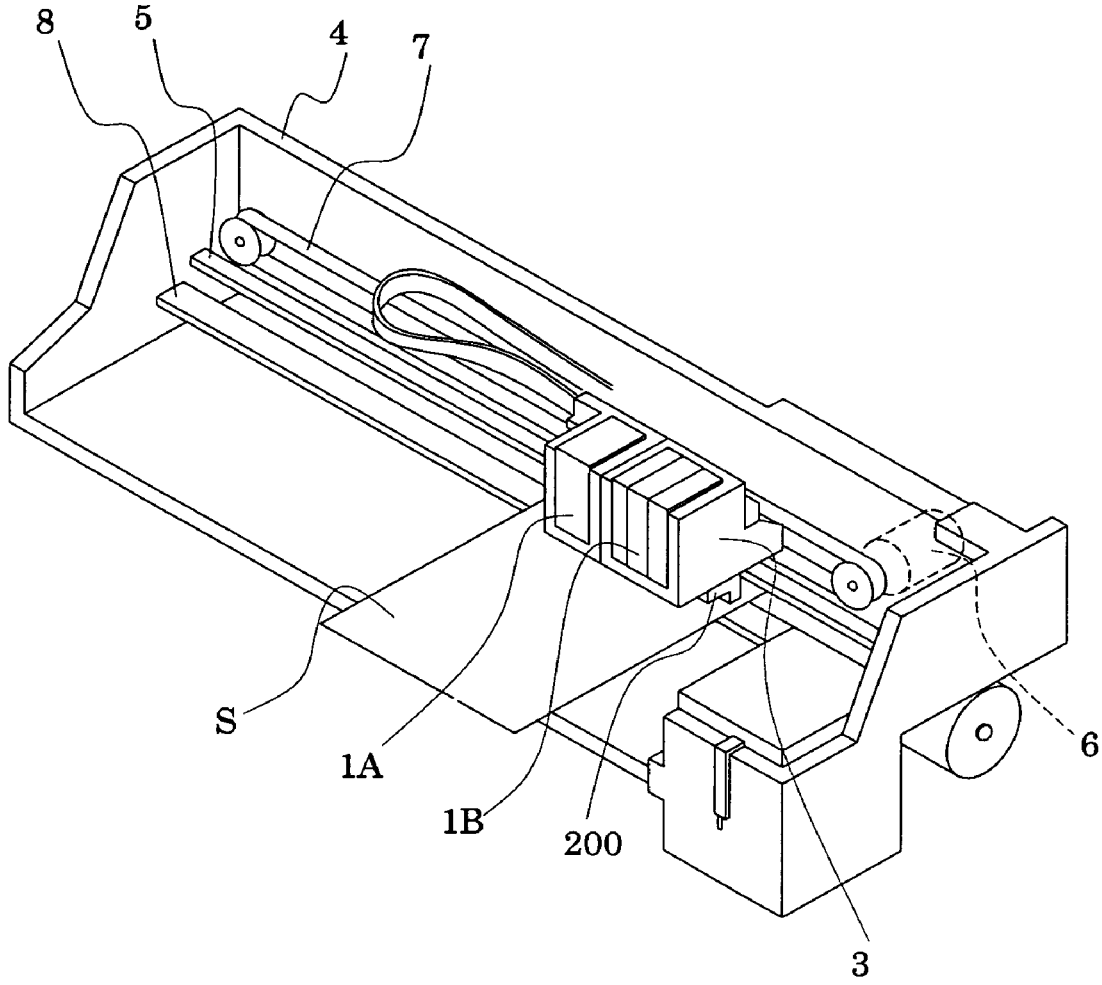
FIG. 6 is a schematic view of an ink jet recording device according to Embodiment 1.

The head unit 200 as described above is mounted on an ink jet recording device. FIG. 6 is a schematic view showing an example of the ink jet recording device. As shown in FIG. 6, to the head unit 200 including an ink jet recording head, cartridges 1A and 1B constituting ink supply means are provided in manner that the cartridges 1A and 1B are freely detachable from the head unit 200. A carriage 3, on which the head unit 200 is mounted, is provided to a carriage axis 5 fixed to a device body 4 in a manner that the carriage 3 is freely movable in an axial direction. The head units 200 are configured to eject a black-ink composition and color-ink compositions, respectively.

Additionally, driving force of a driving motor 6 is transferred to the carriage 3 through a plurality of gears not illustrated and a timing belt 7, and thereby the carriage 3, on which the head unit 200 is mounted, is moved along the carriage axis 5. On the other hand, a platen 8 is provided along the carriage axis 5 in the device body 4, and a recording sheet S, which is a recording medium such as a sheet of paper fed by a feeding roller not illustrated, is conveyed on the platen 8.

Another Embodiment

Although Embodiment 1 of the present invention has been described hereinabove, the present invention is not limited to the above described embodiment. For example, although in above described Embodiment 1, the head cases 230 are fixed respectively to the plurality of ink jet recording heads 220, the present invention is not particularly limited to this. For example, the plurality of ink jet recording heads 220 may be fixed to a single head case.

Additionally, although in above described Embodiment 1, the head case 230 is fixed onto the passage-forming substrate 10 of the ink jet recording head 220 with the protective plate 30 interposed therebetween, the present invention is not particularly limited to this. For example, the head case 230 may be fixed directly onto the passage-forming substrate 10. In other words, fixing of the head case 230 to the passage-forming substrate 10 in the present invention means the fixing of the head case 230 directly, or with another member such as the protective plate 30 interposed in between, to passage-forming substrate 10. In any case, it is possible to reduce warpage of the ink jet recording head by using the head case 230 having a predetermined linear expansion coefficient.

Furthermore, although the ink jet recording head 220 of a flexure vibration mode is given as an example in above described Embodiment 1, the present invention is not limited to this. It is needless to say that the present invention can be applicable to a head unit having an ink jet recording head of various structures, such as an ink jet recording head of a longitudinal vibration mode or an ink jet recording head causing ink droplets to be ejected by bubbles generated by heat generation of heat generating elements or the like. In the ink jet recording head of a longitudinal vibration mode, piezoelectric elements and electrode forming materials are alternately laminated and are caused to expand and contract in an axial direction.

Note that, although the head unit and the ink jet recording device each including, as a liquid-jet head, an ink jet recording head ejecting ink have been described as an example, the present invention is broadly aimed for liquid-jet head units and liquid-jet apparatuses each including a liquid-jet head in general. As other liquid-jet heads, there can be cited for example: a recording head used in image recording apparatuses such as a printer; a coloring material injection head used for producing color filters for liquid crystal displays; an electrode material injection head used for forming electrodes for organic EL displays, a FED (field emission display) or the like; and a bio-organic material injection head used for producing bio-chips.

What is claimed is:

1. A liquid-jet head unit, comprising:

an liquid-jet head in which nozzle orifices for ejecting ink droplets are arranged in parallel lines to each other; and a head case fixed to the liquid-jet head, wherein a linear expansion coefficient of the head case in a reference direction, which is a direction in which the nozzle orifices of the head case are arranged in parallel lines, is set less than a linear expansion coefficient thereof in a direction orthogonal to the reference direction.

2. The liquid-jet head unit according to claim 1, wherein the reference direction of the head case is a longitudinal direction of the liquid-jet head.

3. The liquid-jet head unit according to claim 1, wherein the head case is formed of a liquid crystal polymer.

4. The liquid-jet head unit according to claim 1, wherein the liquid-jet head includes a passage-forming substrate formed of a single crystal silicon substrate, and pressure generating chambers communicating with the respective nozzle orifices are respectively formed in divisions on the passage-forming substrate, and wherein the head case is fixed to the passage-forming substrate.

5. The liquid-jet head unit according to claim 4, wherein the head case is fixed to the passage-forming substrate with a protective plate interposed therebetween, the protective plate being connected to the passage-forming substrate and formed of a material having a linear expansion coefficient substantially equal to that of the passage-forming substrate.

6. The liquid-jet head unit according to claim 1, wherein the head case is molded in order that the reference direction can be an injection flow direction.

7. A liquid-jet apparatus, comprising the liquid-jet head in claim 1.

8. A liquid-jet apparatus, comprising the liquid-jet head in claim 2.

9. A liquid-jet apparatus, comprising the liquid-jet head in claim 3.

10. A liquid-jet apparatus, comprising the liquid-jet head in claim 4.

11. A liquid-jet apparatus, comprising the liquid-jet head in claim 5.

12. A liquid-jet apparatus, comprising the liquid-jet head in claim 6.

* * * * *